US008347581B2

(12) United States Patent
Doerr et al.

(10) Patent No.: US 8,347,581 B2
(45) Date of Patent: Jan. 8, 2013

(54) ADJUSTABLE MASONRY ANCHOR ASSEMBLY FOR USE WITH INSULATING CONCRETE FORM SYSTEMS

(75) Inventors: Kelvin L. Doerr, Omaha, NE (US); Henry E. Pfeiffer, Omaha, NE (US)

(73) Assignee: Reward Wall Systems, Inc., Omaha, NE (US)

( * ) Notice: Subject to any disclaimer, the term of this patent is extended or adjusted under 35 U.S.C. 154(b) by 968 days.

(21) Appl. No.: 11/859,380

(22) Filed: Sep. 21, 2007

(65) Prior Publication Data

US 2008/0092472 A1 Apr. 24, 2008

Related U.S. Application Data

(60) Provisional application No. 60/829,997, filed on Oct. 18, 2006.

(51) Int. Cl.
*E04B 1/38* (2006.01)
*E04C 5/00* (2006.01)

(52) U.S. Cl. ..... 52/700; 52/698; 52/712; 52/379; 52/562

(58) Field of Classification Search ..... 52/712–715, 52/698, 700, 701, 378, 379, 562, 565, 568, 52/426
See application file for complete search history.

(56) References Cited

U.S. PATENT DOCUMENTS

| | | | | |
|---|---|---|---|---|
| 4,021,990 | A * | 5/1977 | Schwalberg | 52/479 |
| 4,869,043 | A | 9/1989 | Hatzinikolas et al. | |
| 5,207,043 | A * | 5/1993 | McGee et al. | 52/379 |
| 5,313,752 | A | 5/1994 | Hatzinikolas | |
| 5,392,581 | A | 2/1995 | Hatzinikolas et al. | |
| 5,845,449 | A | 12/1998 | Vaughan et al. | |
| 5,890,337 | A * | 4/1999 | Boeshart | 52/426 |
| 6,209,281 | B1 * | 4/2001 | Rice | 52/714 |
| 6,739,105 | B2 * | 5/2004 | Fleming | 52/513 |
| 6,820,384 | B1 | 11/2004 | Pfeiffer | |
| 6,941,717 | B2 * | 9/2005 | Hohmann et al. | 52/506.01 |
| 7,225,590 | B1 * | 6/2007 | diGirolamo et al. | 52/379 |
| 7,325,366 | B1 * | 2/2008 | Hohmann et al. | 52/513 |
| 7,587,874 | B2 * | 9/2009 | Hohmann, Jr. | 52/714 |
| 2010/0037552 | A1 * | 2/2010 | Bronner | 52/713 |

FOREIGN PATENT DOCUMENTS

CA 1251336 3/1989

(Continued)

*Primary Examiner* — Joshua J Michener
*Assistant Examiner* — Elizabeth A Plummer
(74) *Attorney, Agent, or Firm* — Samuel Digirolamo; Husch Blackwell LLP

(57) ABSTRACT

An anchor assembly for use in joining together a masonry wall structure and a supporting back wall structure wherein the back wall structure is preferably formed using insulated concrete form (ICF) blocks each having a pair of opposed ICF panels associated therewith, the anchor assembly including an anchor member and a tie member. The anchor member includes an anchor portion adapted to penetrate one of the ICF panels and having at least one opening associated therewith so as to lie between the opposed ICF panels when attached thereto for allowing poured concrete to flow therethrough, and an attachment portion having a tab member positioned and located to overlay an ICF panel flange member when the anchor member is inserted within the ICF panel, the tab member being attachable to the ICF panel flange member. The attachment portion further includes an elongated slot for receiving the tie member, the tie member being adjustably movable along the length of the slot so as to be positionable between the courses of brick or other masonry material associated with the masonry wall structure as the masonry wall structure is being erected.

12 Claims, 6 Drawing Sheets

FOREIGN PATENT DOCUMENTS

| | | |
|---|---|---|
| CA | 1294457 | 1/1992 |
| CA | 1306116 | 8/1992 |
| CA | 2034085 | 2/1995 |
| CA | 2102297 | 1/2001 |

* cited by examiner

ADJUSTABLE MASONRY ANCHOR ASSEMBLY FOR USE WITH INSULATING CONCRETE FORM SYSTEMS

CROSS-REFERENCE TO RELATED APPLICATION

This application claims the benefit of U.S. Provisional Patent Application No. 60/829,997, filed on Oct. 18, 2006, the disclosure of which is incorporated herein by reference.

BACKGROUND OF INVENTION

The present invention relates to a connector assembly for joining or tying together a masonry structure with a supporting back-wall structure and, more particularly, to an adjustable masonry anchor assembly for use with Insulating Concrete Form (ICF) systems wherein the present masonry anchor is embedded into the ICF system during the wall forming process.

Brick, stone, and other masonry veneers or other exterior cladding is oftentimes used in construction to present a wide variety of different aesthetically pleasing exterior appearances to a building or other structure. Typically, this outer masonry wall is spaced from the supporting back-up wall forming a spacer cavity therebetween for insulation purposes. This outer masonry wall is typically joined or tied to the supporting back-up wall through the use of conventional wall ties or connectors that extend across the spacer cavity formed therebetween such as the connectors illustrated in U.S. Pat. Nos. 4,869,043 and 5,392,581. Such known connectors have utility when being used in conjunction with back-up wall structures formed from concrete blocks, wooden or metal studs (stud wall), or other similar back wall structures. Such known connectors, however, are not particularly adaptable for use with the growing use of ICF systems commonly used today for both residential and commercial construction.

ICF systems are well-known and serve to contain fluid concrete while it solidifies as well as provide insulation for the finished structure. Such systems utilize a plurality of individual units, panels or blocks aligned horizontally and vertically in an interlocking arrangement to create forms for concrete walls. Each unit or block includes a pair of foam panels which are retained in spaced apart parallel relationship to each other by a plurality of ties which are embedded into the foam panels to hold the panels together. These spacing ties are truss-like in nature and include opposing flange portions which reside within the respective opposing foam panels. The opposing tie flange portions are separated by an intermediate web portion connected therebetween enabling the tie to hold and secure the panels in proper spaced relationship to each other. These ICF systems serve as forms for poured concrete walls and yield a solid, continuous concrete wall construction when connected horizontally and vertically to blocks of similar construction. However, instead of being removed after the concrete has hardened, the ICF forms remain in place and become part of the wall structure. As such, the ICF forms provide insulation on both the inside and the outside of the wall. The ties within the ICF forms also act as furring strips so that interior and exterior finishes can be applied directly to the foam blocks.

ICF forms are typically made of expanded polystyrene and the embedded ends of the ICF ties positioned to hold the foam panels together include opposed portions which are flattened out to form fastening surfaces recessed within the corresponding panels to allow for any type of exterior or interior finish. Since the ties run the full height of the ICF forms, an ICF wall contains continuous furring strips from foundation to the eave line.

To construct an ICF wall, one simply stacks the ICF forms to shape the particular wall, install vertical and horizontal rebar to reinforce the concrete, and fill the center cavity of the ICF forms with concrete. Use of the known masonry connectors such as the connectors disclosed in U.S. Pat. Nos. 4,869,043 and 5,392,581 are not easily adaptable for use with ICF wall systems for a wide variety of reasons including the fact that walls formed using ICF systems result in solid concrete walls thereby rendering the attachment mechanisms associated with the known connectors inoperative in this particular application. Also, the various constructions of such known connectors are not compatible for use with ICF systems.

It is therefore desirable to provide a masonry connector which is specifically adaptable for use with ICF systems, which includes adjustable means for accommodating construction tolerances and for alignment with the masonry mortar joints, and which includes means for easy attachment to the ICF system.

Accordingly, the present invention is directed to an adjustable masonry anchor assembly which overcomes one or more of the problems set forth above for attaching to a wide variety of different ICF systems.

SUMMARY OF INVENTION

The present invention overcomes many of the shortcomings and limitations of the prior art devices discussed above and teaches the construction and operation of an adjustable masonry anchor assembly adaptable for use with a wide variety of different types of ICF systems wherein the main anchor member is attached to the ICF forms prior to pouring or filling the center cavity of the ICF forms with concrete. In one aspect of the present invention, the present masonry anchor assembly includes two separate members, the main anchor member and a cooperatively engageable masonry tie wire member. The anchor member is installed as the ICF wall is being constructed, whereas the masonry tie wire member is installed as the brick or other masonry facing wall is being constructed.

The present anchor member is formed from a substantially planar plate-like member and includes an anchor portion and an attachment portion. The terminal end of the anchor portion of the present anchor member is preferably triangularly shaped or otherwise includes a pointed end portion for facilitating the penetration of the anchor portion through the ICF foam panel as will be hereinafter explained. The anchor portion also includes at least one large opening through which concrete will flow when properly positioned within an ICF system wall when concrete is poured therewithin. The attachment portion of the present anchor member includes a tab member which is positioned substantially perpendicular to the anchor member and includes a plurality of openings for cooperatively receiving suitable fastening members for attaching the anchor member to the opposed flange portions of the truss-like spacing ties associated with the ICF forms.

To install the present anchor member, the anchor member is inserted through a slot formed in the ICF foam panel adjacent one of the opposed flange portions of the truss-like spacing ties embedded therein such that when the anchor member is inserted therewithin, the attachment tab portion will lie flush with the face of the ICF form and overlay the embedded flange portion associated with the spacing tie. In this regard, the tab portion is approximately the same width as the ICF tie flange portion. Once inserted, the anchor member is attached to the ICF form by inserting appropriate fastening members through the openings associated with the tab member and attaching the tab member to the embedded flange portion associated with the ICF tie member. When so attached, the anchor portion of the present anchor member extends inwardly into the space form by and between the opposed ICF panels and the opening associated with the anchor portion lies within the open space or center cavity formed within the ICF form and is positioned so as to receive the concrete as it is poured within the form. Attaching the tab member to the tie member associated with the ICF form through the use of appropriate fastening members is only a temporary attachment so as to hold the anchor member in proper position during pouring of the concrete into the ICF form for permanent joinder thereto. When the concrete is poured and has hardened, it anchors the main anchor member to the ICF wall being formed.

The attachment portion of the anchor member also includes an elongated slot located adjacent the tab member for receiving a tie wire member which can be adjustably positioned along the length of the slot so as to be positioned in alignment with the masonry mortar joint between the courses of brick or other masonry material as the masonry wall is being erected in front of the ICF formed wall system. These masonry tie wire members are embedded in the mortar between two courses of the brick or other masonry material and are fixedly secured thereto once the mortar hardens. Because the exact location of the mortar joint between two courses of brick or other masonry material in the vicinity of each respective anchor assembly is unknown at the time that the respective anchor member is embedded and secured within the ICF form, the elongated slot provides adjustability and flexibility to the user so as to properly position the masonry tie wire member at the proper position and location so as to extend directly into the mortar joint between two courses of the masonry material. The present masonry tie wire member is cooperatively engageable with the elongated slot associated with the attachment portion of the anchor member and can take on a wide variety of different shapes to accomplish the present task.

Any plurality of the present masonry anchor members can be utilized in association with a particular supporting ICF back-up wall and a front facing masonry wall to join, tie, or otherwise permanently fix the outer masonry wall to the supporting ICF back-up wall.

These and other objects and advantages of the present invention will become more apparent to those skilled in the art after considering the following detailed specification taken in conjunction with the accompanying drawings.

BRIEF DESCRIPTION OF DRAWINGS

For a better understanding of the present invention, reference may be made to the accompanying drawings.

DETAILED DESCRIPTION

Figure 1:
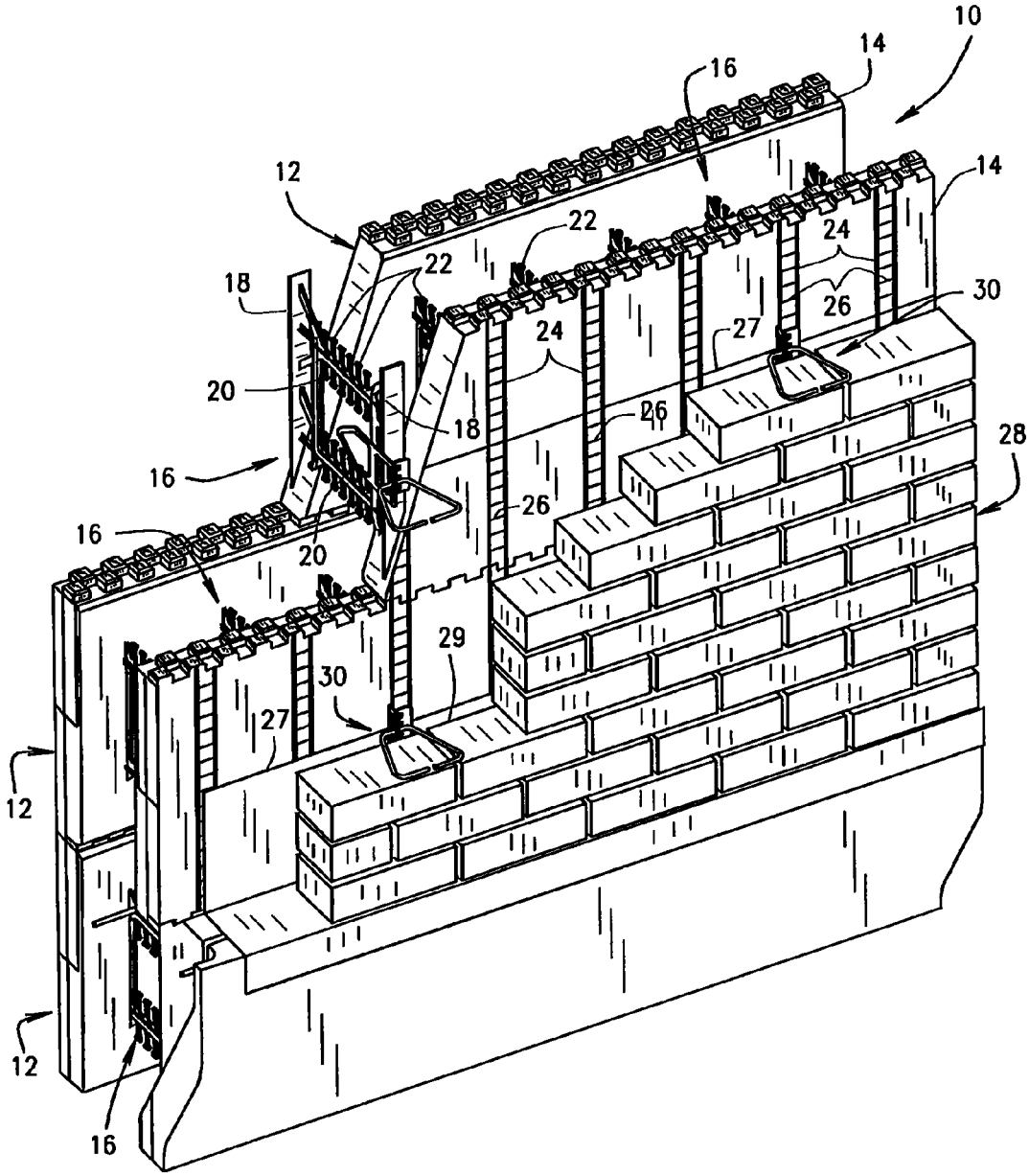
FIG. 1 is a perspective view of an ICF supporting wall structure and a masonry structure, partly cut-away, incorporating the present anchor assemblies made in accordance with the teachings of the present invention.
Figure 2:
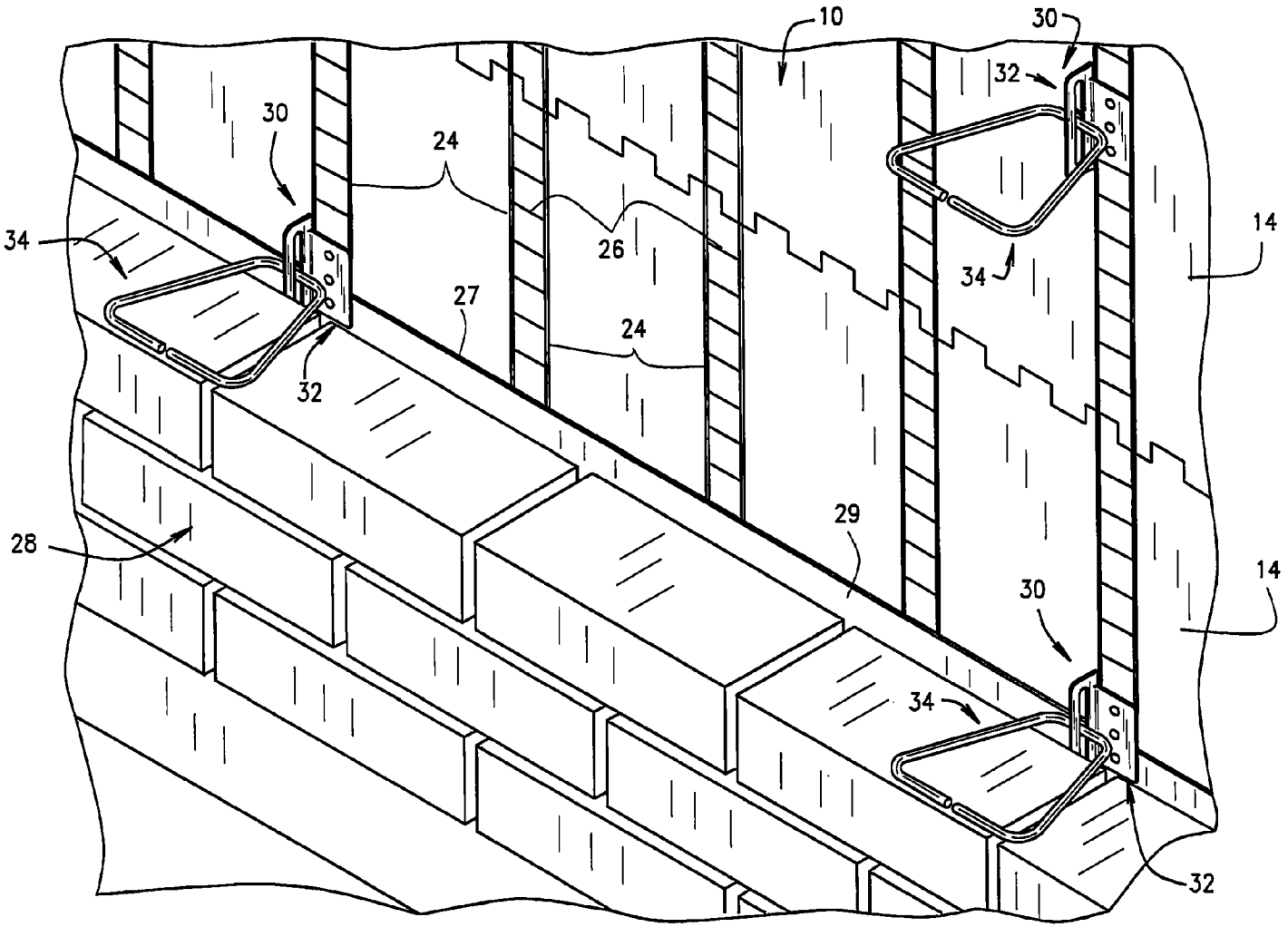
FIG. 2 is a partial perspective view showing the positioning of the present anchor assemblies on the ICF supporting wall structure relative to the masonry wall structure.
Figure 3:
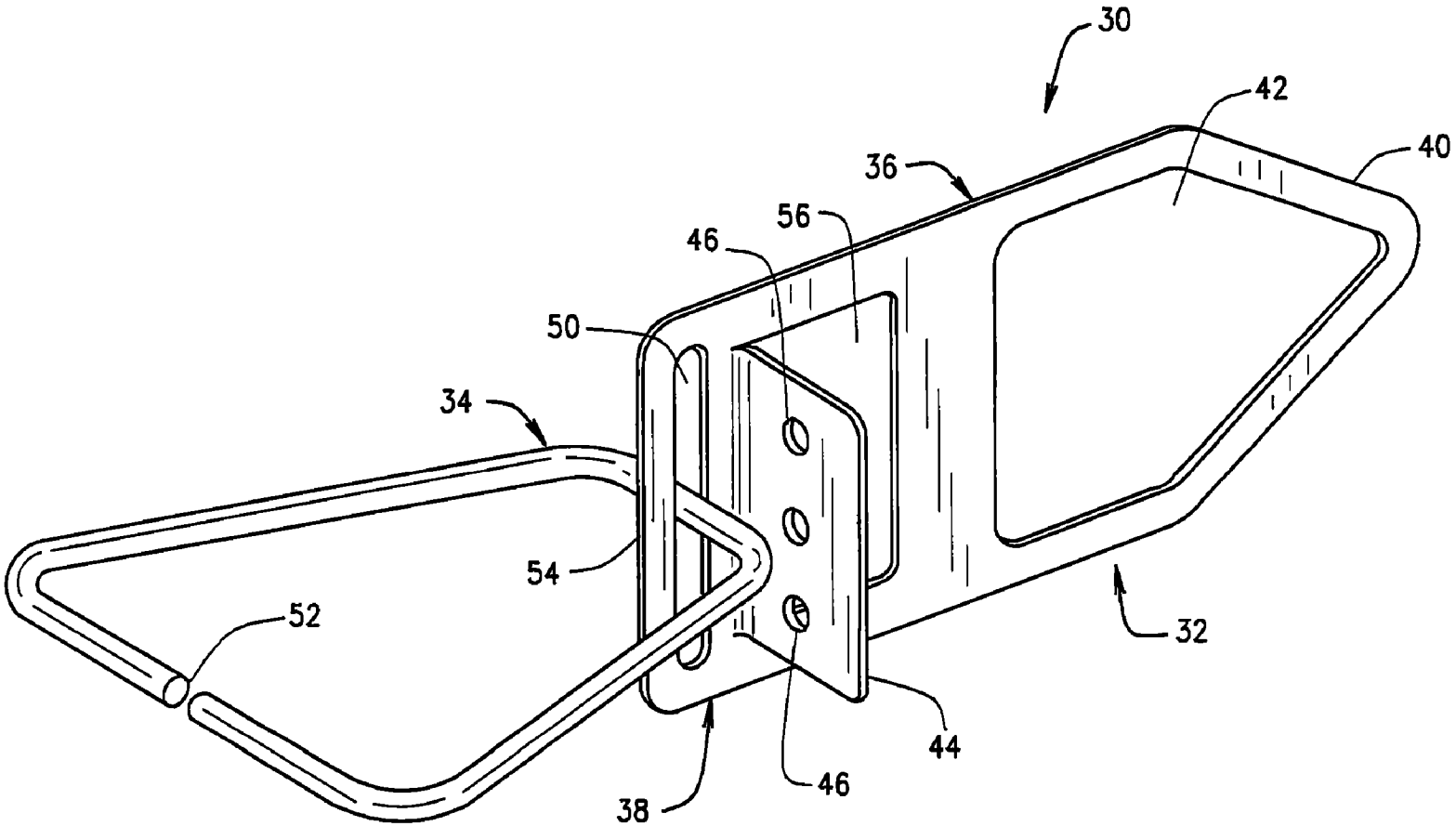
FIG. 3 is a perspective view of one embodiment of the present anchor assembly.

Referring to the drawings more particularly by reference numbers wherein like numerals refer to like parts, the number 30 in FIGS. 1-3 identifies one embodiment of an adjustable masonry anchor assembly constructed according to the teachings of the present invention. FIGS. 1 and 2 illustrate a typical use of the present anchor assembly 30 for joining or tying together a masonry structure such as the conventional brick wall structure 28 which is positioned and located in spaced apart relationship in front of a supporting back-wall structure 10 which is formed using a conventional ICF system. As best shown in FIG. 2, the brick wall or other masonry veneer 28 is positioned in front of the back-wall structure 10 so as to form a space or cavity 29 therebetween. As discussed below, this space or cavity 29 is sufficient to receive and accommodate the attachment portion 38 of the present anchor assembly 30 as will be hereinafter further explained.

Figure 4:
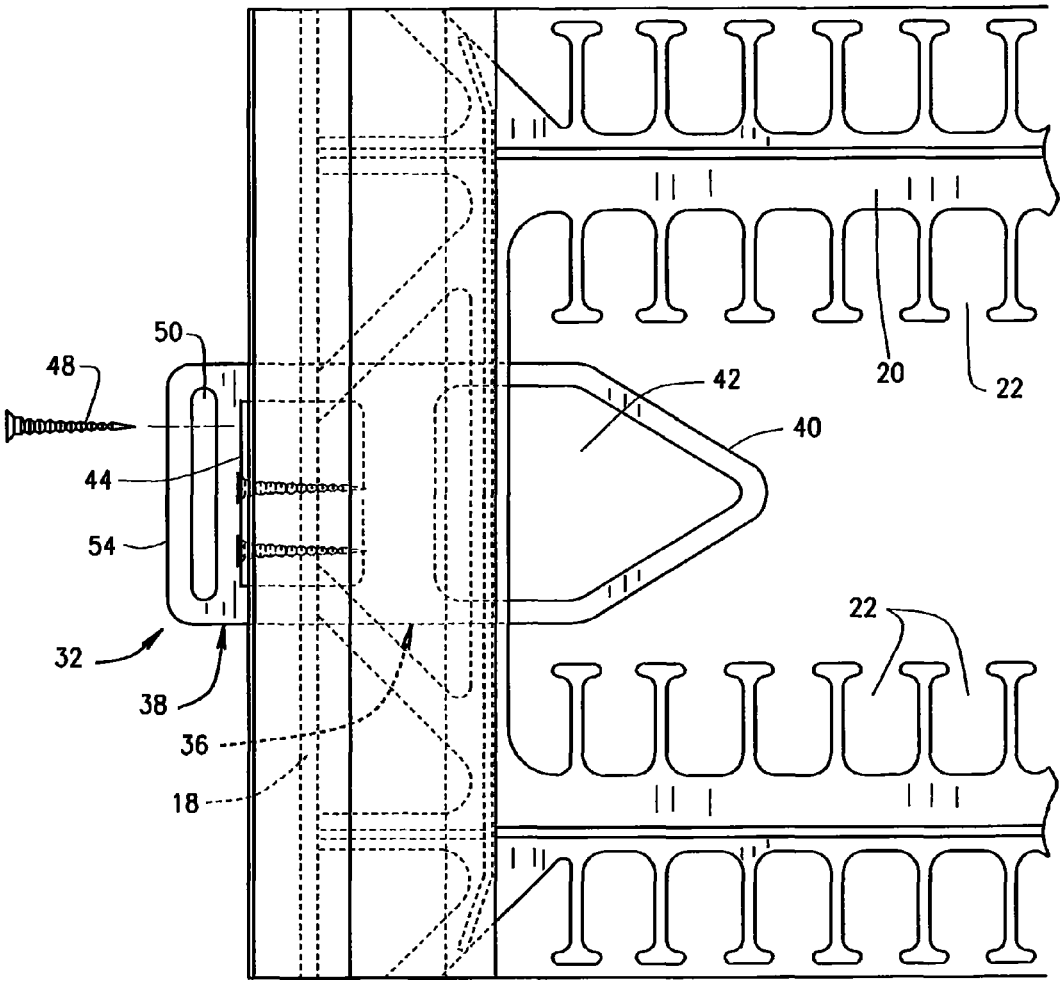
FIG. 4 is an enlarged partial cut-away view of one of the ICF blocks showing the present anchor member attached to a corresponding ICF tie flange member.
Figure 6:
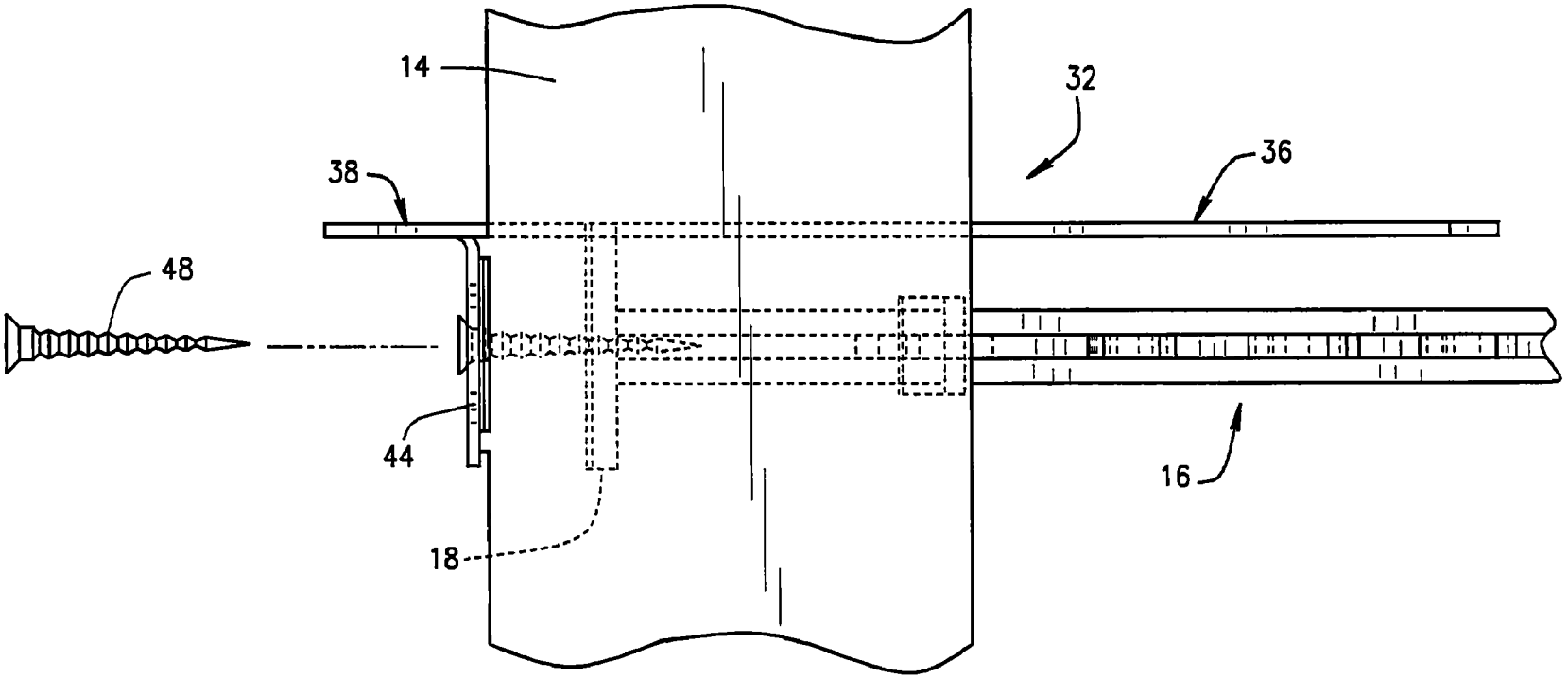
FIG. 6 is a partial top plan form view showing the present anchor member being attached to a corresponding ICF tie flange member.

The supporting back-wall structure 10 is formed by a plurality of individual ICF foam blocks 12 which are aligned horizontally and vertically in an interlocking arrangement to create the form for a specific concrete wall. Each ICF block 12 includes a pair of parallel opposing foam panels 14 retained in spaced apart relationship to each other by a plurality of ICF form ties 16. Each tie 16 includes a pair of opposed flange members 18 which are separated by, and connected to, a web portion which includes opposing truss members connected by a pair of substantially identical transverse bridge members 20, each bridge member 20 having a plurality of rebar retaining seats 22 molded therein. As best illustrated in FIGS. 1, 4 and 6, the plurality of spacing ties 16 extend transversely between the opposing inner surfaces of the opposing panels 14 such that the opposing flange members 18 of each respective tie 16 are substantially retainably encapsulated or embedded within each respective opposed foam panel 14 such that each flange member 18 is seated inwardly from the outer surface of the panel 14 within which it is encapsulated. The tie web portion is designed to provide centralized structural support to the block 12 and to optimize the flow of concrete poured between the opposing panels 14. In a preferred embodiment, the ties 16 are constructed from a plastic material such as polypropylene. In other embodiments, the spacing ties can be constructed from metal, or other suitable materials.

The rebar seats 22 are substantially identical to each other in configuration, and are arranged in a pair of opposing rows along each transverse bridge member 20. Each seat 20 includes a substantially U-shaped well formed by a plurality of adjacent fingers. These adjacent fingers are shaped and configured to create a substantially U-shaped well that is capable of retaining either one or a pair of rebar rods positioned therein.

Both the opposing horizontal top and bottom longitudinal edges of the panels 14 as well as the opposing vertical ends of each panel 14 include cooperatively engageable means typically in the form of an array of alternating teeth and sockets as best illustrated in FIG. 1 for vertically and horizontally interlocking similarly constructed ICF form blocks 12 to one another to create the particular concrete wall desired. At the construction site, the appropriate ICF blocks 12 are engaged in the appropriate manner to form the particular supporting back-wall structure desired; rebar rods may be retainably placed within the rebar seats 22 to provide additional strength and stability to the finished wall structure; and concrete is poured into the center cavity formed between the respective ICF blocks 12 to yield a particular solid, continuous concrete wall structure.

Although it is recognized that a wide variety of different types of ICF systems are available for use, it is important to note that the opposing flange members 18 associated with each respective ICF spacing tie 16 run substantially the full vertical height of each respective ICF block 12 thereby providing strength throughout the height of the respective blocks as well as throughout the height of the entire wall structure as best illustrated in FIGS. 1 and 2. In a preferred embodiment, the flange members 18 are of sufficient height, width and thickness such that the flanges can serve as a stud to which interior and exterior facades can be anchored. The inner and outer surfaces of the respective ICF panels 14 are substantially flat surfaces and each respective panel is of an appropriate thickness such that the flange members 18 are positioned inwardly from the outer surface thereof by a sufficient distance to facilitate use as a stud as best illustrated in FIGS. 4 and 6. This interior positioning of the flange members 18 likewise facilitates attachment of the present anchor assembly 30 to such flange members as will be hereinafter further explained.

In order to facilitate locating the flange members 18 embedded within each respective ICF panel 14 to serve as anchoring studs for the anchor assembly 30, a pair of flange indicators 24 are molded into the outer surface of the respective panels 14 as best illustrated in FIGS. 1 and 2. A plurality of spaced horizontal indicators 26 are likewise molded into the outer surface of each respective panel and are positioned between the pair of indicators 24 to further visually identify the location of the respective flange members 18 embedded therewithin. This ladder tie identification design makes its easy for a worker to quickly and easily identify and locate the flange members 18 associated with each respective spacing tie 16 for both aligning the respective ties when the ICF blocks 12 are vertically stacked one upon another to create a wall structure, and for serving as anchoring studs for the anchor assemblies 30.

In addition, the exterior surface of each ICF block 12 likewise typically includes a mark or indicator 27 in the form of a raised horizontal bead line along its central longitudinal axis to mark the mid-height of each respective block. The indicator 27 is provided in the event that it is necessary or desirable to sever a block 12 laterally into equal halves. As such, the indicator line 27 is positioned between the upper and lower bridge members 20 associated with the plurality of ICF form ties 16 such that severing of the block 12 will not interfere with either bridge member 20. The indicators 26 can also be dimensionally spaced such that they can be used as a measuring guide. For example, the indicators 26 could be spaced at intervals of one inch or some other predetermined distance to facilitate measuring and cutting such blocks at a location offset from the central longitudinal axis 27 of the block.

The supporting back-wall structure 10 and the masonry wall structure 28 are joined or tied together by a plurality of the present anchor assemblies 30 as best illustrated in FIGS. 1 and 2. Each anchor assembly 30 includes a main anchor member 32 and a cooperatively engageable masonry tie member 34 as best illustrated in FIG. 3. The anchor member 32 is substantially planar in form and includes an anchor portion 36 and an attachment portion 38. The terminal end 40 of the anchor portion 36 is preferably triangularly shaped as illustrated for facilitating the penetration of the anchor portion 36 through the ICF foam panel 14 as will be hereinafter explained. Although the anchor portion 36 is illustrated as being substantially triangular in shape, it is recognized and anticipated that other shapes of the anchor portion 36 including a shape yielding a pointed end portion will likewise facilitate insertion and penetration of the anchor portion 36 into the ICF wall system. The anchor portion 36 also includes opening 42 through which concrete will flow when properly positioned within an ICF system wall as will be hereinafter further explained.

The attachment portion 38 of anchor member 32 includes a tab member 44 which is positioned substantially perpendicular to the anchor member 32 as illustrated in FIG. 3. Tab member 44 includes a plurality of openings 46 for cooperatively receiving suitable fastening members such as the fastening members 48 for attaching the anchor member 32 to the opposed ICF tie flange portions 18 as will be explained. The attachment portion 38 of anchor member 32 likewise includes an elongated slot 50 located adjacent the tab member 44 for receiving the tie member 34 which can be adjustably positioned along the length of the slot 50 so as to be positioned in alignment with a particular masonry mortar joint as will be likewise hereinafter explained. The anchor tie member 34 is likewise somewhat triangular in shape and includes an opening or slot 52 which is sized and shaped to receive the terminal end portion 54 of the attachment portion 38 for operatively engaging and positioning the tie member 34 within the elongated slot 50. Although the anchor tie member 34 is shown as being substantially triangular in shape, it is likewise recognized and anticipated that the tie member 34 can take on a wide variety of different sizes and shapes while still accomplishing the present task as will be further explained.

Figure 5:
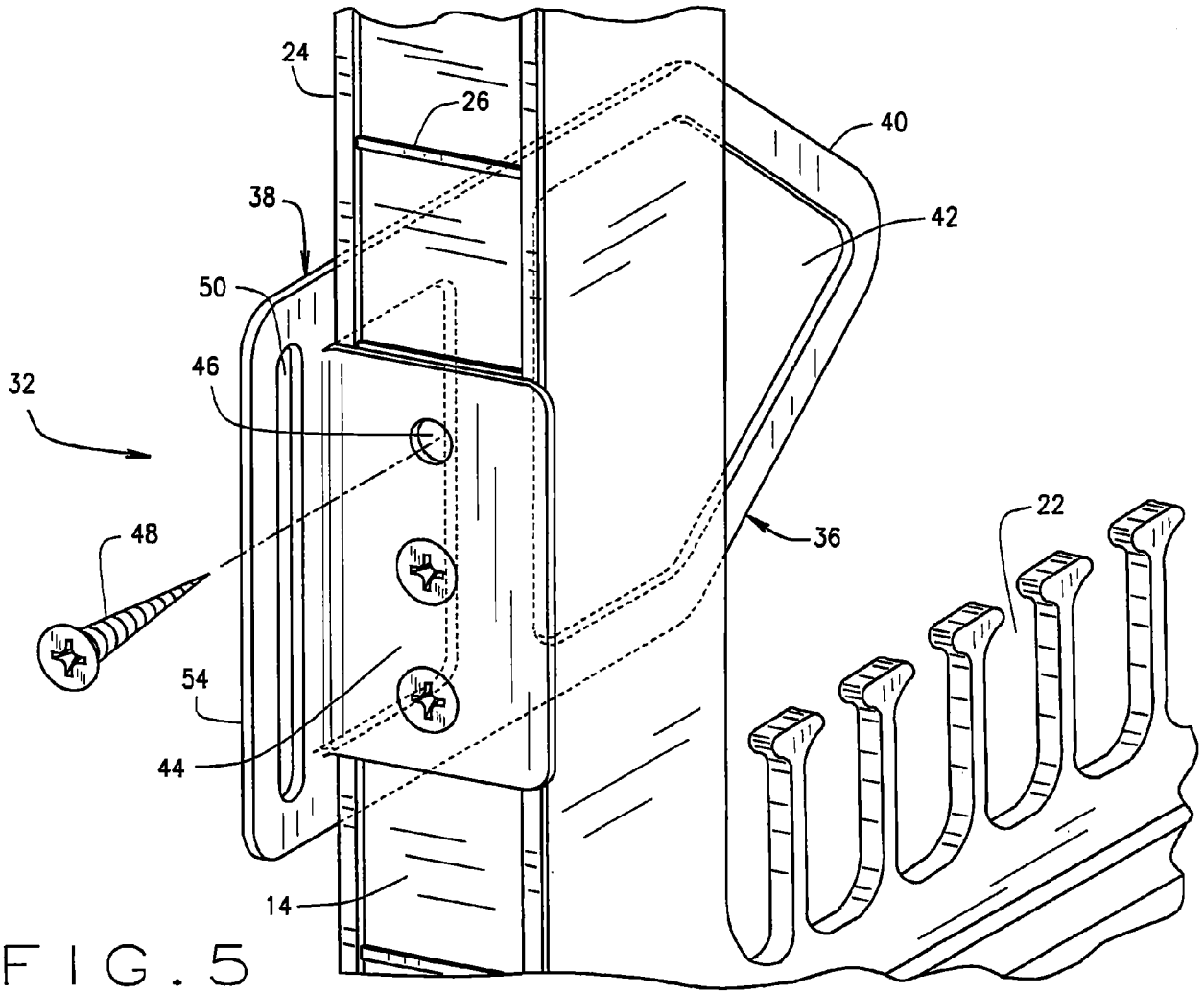
FIG. 5 is a partial perspective view showing the tab member associated with the anchor member positioned relative to a corresponding ICF tie flange member for attachment thereto.

To install any one of the present anchor assemblies 30, the anchor member 32 is inserted through a slot previously formed in the ICF foam panel 14 adjacent one of the opposed ICF tie flange members 18 embedded therein such that when the anchor member 32 is inserted therewithin, the tab member 44 will lie flush with the outer face of the ICF panel 14 and overlay the embedded flange member 18 as best illustrated in FIGS. 1, 2, 5 and 6. Locating the appropriate flange member 18 is easily accomplished by locating the appropriate flange indicator 24 (FIGS. 1 and 2) which identifies one side portion of the flange member 18 and thereafter cutting an appropriate slot through the ICF panel 14 adjacent thereto for inserting the anchor portion 36 of the anchor member 32 therethrough. In this regard, the anchor member 32 is vertically oriented when inserted through the slot formed in the ICF panel 14 as best illustrated in FIGS. 4 and 5. When the anchor member 32 is properly positioned within the pre-formed slot adjacent the ICF tie flange member 18, the anchor tab member 44 will lie flush with the face of the ICF panel 14 and will overlay the embedded flange member 18 as best shown in FIGS. 5 and 6. In this position, the fastening members 48 can be inserted through the tab openings 46 and should be of sufficient length so as to engage the tie flange member 18 as best shown in FIG. 6. Attaching the tab member 44 to the tie flange member 18 through the use of the fastening members 48 is only a temporary attachment so as to hold the anchor member 32 in proper position during pouring of the concrete into the central cavity of the ICF block for permanent joinder thereto. In this regard, any number of tab openings 46 and any number of fastening members 48 may be used in order to accomplish this temporary joinder.

As best illustrated in FIGS. 4-6, when the anchor member 32 is properly positioned and attached to a respective ICF tie flange member 18, the anchor portion 36 of anchor member 32 and, more particularly, the opening 42 associated therewith extends inwardly into the cavity space formed by and between the opposed ICF panels 14. This is further illustrated in FIG. 1. In this regard, the anchor member 32 should be positioned vertically along the height of the ICF block 12 such that the anchor portion 36 extends into the ICF cavity space between the respective upper and lower bridge members 20 associated with the plurality of formed ties 16. This is easily accomplished by locating the mid-height indicator 27 and centering the anchor member 32 on this line next to an adjacent ICF tie flange member 18 as previously explained. This will ensure that the opening 42 associated with the anchor portion 36 lies within the open space formed within the ICF block 12 and is properly positioned so as to receive the concrete as it is poured within the form. When the concrete is poured and has cured and hardened, the concrete anchors the anchor member 32 to the ICF wall being formed as illustrated in FIGS. 1 and 2.

In addition, as best illustrated in FIG. 2, when the anchor member 32 is properly positioned and attached to the ICF tie flange member 18, the elongated slot 50 associated with the attachment portion 38 of anchor member 32 lies in the space or cavity formed by and between the supporting back-wall structure 10 and the masonry wall 28. In this regard, the terminal end portion 54 of the anchor member 32 can be sized and shaped so as to be cooperatively received within the slot or space 52 and its dimensions can be adjusted to accommodate any particular application. Once the anchor member 32 is properly positioned and secured to the ICF system as previously explained, the anchor tie member 34 is cooperatively engaged with the anchor slot 50 as previously explained and such tie member 34 can be adjustably positioned along the length of the slot 50 so as to be in alignment with a masonry mortar joint between two respective courses of brick or other masonry material as the masonry wall 28 is being erected in front of the ICF supporting wall system 10. As best illustrated in FIGS. 1 and 2, because the exact location of the mortar joint between two courses of brick or other masonry material in the vicinity of the anchor assembly 30 is unknown at the time that the anchor member is embedded and secured within the ICF form, the elongated slot 50 provides adjustability and flexibility to the user so as to properly position the tie member 34 at the proper position and location so as to rest on the top surface of one course of brick or other masonry material and extend directly into the mortar joint formed between two courses of masonry material. This adjustability can also accommodate construction tolerances and larger differential movement. Once the masonry tie member 34 is embedded in the mortar between two courses of brick or other masonry material, it is fixedly secured to the masonry wall being erected in front of the ICF formed wall system once the mortar joint hardens. Wall and mortar joint layout will typically be coordinated between the locations of the mortar joints and the positions of the various anchor assemblies 30 associated with the supporting ICF system wall.

As illustrated in FIGS. 1 and 2, it is recognized that any plurality of the present masonry anchor assemblies 30 can be utilized in association with a particular supporting ICF back-up wall such as the supporting wall 10 and a front facing masonry wall such as the brick wall structure 28 to join, tie or otherwise permanently fix the outer masonry wall to the supporting ICF back-up wall. As a result, the anchor assemblies 30 join the supporting back-up wall and the masonry wall at spaced locations to produce an effective tying arrangement between the two wall systems capable of resisting lateral loads including the negative and positive lateral loads imposed by seismic and wind occurrences.

As best illustrated in FIG. 3, the anchor member 32 may include additional openings such as the opening 56 which may be incorporated into the anchor member 32 for manufacturing purposes and/or for weight considerations. For example, the anchor member 32 can be fabricated from a substantially planar plate-like member wherein the terminal end portion 40, the opening 42, and the slot 50 can be easily formed during a stamping operation. In addition, the tab member 44 can be cut from the base plate-like member and folded or otherwise bent to its proper position as shown in FIG. 3, thereby forming opening 56. Tab openings 46 can likewise be easily stamped or otherwise formed during a conventional stamping operation. Opening 56, or other openings can likewise be formed in order to reduce the overall weight of the anchor member 32; to provide more open space for capturing concrete as it is poured into the ICF form system; or for other reasons. Other manufacturing processes and variations are likewise recognized and anticipated.

The present anchor assembly 30 can also be fabricated so as to meet the particular design requirements for project specific design loads. Once these parameters are known, the present anchor assemblies 30 can be specifically designed and engineered to meet such requirements particularly if seismic and wind applications are involved. Some building codes may dictate a maximum horizontal and vertical spacing for positioning the present anchor assemblies along with a maximum area of wall to which an anchor assembly must be located. Positioning and locating the present anchor assemblies 30 in accordance with any specific building code requirements or other requirements can be accomplished as discussed above. In addition, the present anchor assemblies can be made from any suitable material such as from stainless steel or hot-dipped galvanized steel. Other materials are likewise available for use depending upon the particular application. In addition, the present assemblies can be made so as to be corrosion resistant.

Although a particular ICF system has been illustrated and disclosed herein, it is recognized that a wide variety of different ICF systems are available in the marketplace and that the present anchor assembly 30 is adaptable for use with any ICF system so long as such system includes a flange member similar to flange member 18 to which the anchor member 32 can be attached. In this regard, it is recognized and anticipated that any ICF block and/or panel construction other than the blocks 12 and panels 14 illustrated in FIGS. 1 and 2 can be utilized with the present anchor assemblies 30 including angularly oriented ICF block forms. In addition, any type of ICF spacing tie other than the ICF tie 16 illustrated in FIG. 1 can be used in conjunction with a particular ICF system so long as flange members 18 or equivalent structure is available for attaching the anchor member 32 thereto.

In addition, while a particular embodiment of the present anchor assembly 30 has been described herein, it is likewise recognized and anticipated that other embodiments are possible within the scope of the present invention. For example, the shape and dimensions of the anchor member 32 may vary widely according to the strength, wall dimensions and other physical characteristics of the particular application. In addition, the anchor tie member 34 may also vary in shape and form, provided only that the key to the mortar joint between two courses of masonry material is adequate to accomplish the desired joinder or tie between the ICF supporting structure and the masonry structure positioned adjacent thereto. As indicated above, other modifications and variations to the particular ICF system being utilized, and to the present anchor member 32 and anchor tie member 34 are envisioned and anticipated.

As is evident from the foregoing description, certain aspects of the present invention are not limited by the particular details of the examples illustrated herein and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings and this disclosure.

The invention claimed is:

1. A connector in combination with at least one insulated concrete form (ICF) foam panel for joining together a masonry wall structure with a supporting concrete back wall structure, the combination comprising:

a connector including an anchor member and a tie member;

a supporting concrete back wall structure including at least one ICF foam panel;

a masonry wall structure including courses of brick or other masonry material;

said anchor member having an anchor portion and an attachment portion;

said anchor portion including at least one opening wherein concrete flows therethrough;

said anchor portion having a terminal end portion sized and shaped for being inserted into and through said at least one ICF foam panel, wherein said anchor portion is inserted into and through said at least one ICF foam panel forming at least a portion of the supporting concrete back wall structure, said anchor portion being inserted prior to pouring the concrete to form the supporting concrete back wall structure;

a majority of said anchor portion being comprised by said at least one opening and said at least one opening being positioned within said anchor portion so as to extend into the supporting concrete back wall structure when said anchor portion is inserted into and through said at least one ICF form panel;

said attachment portion including a tab member positioned and attached to the supporting back wall structure, said tab member having a plurality of openings receiving fastening means for attaching the anchor member to the supporting back wall structure;

said attachment portion further including an elongated slot receiving said tie member;

said tie member being cooperatively engaged with said elongated slot and being adjustably movable along the length of said slot, said tie member being positioned between the courses of brick or other masonry material of the masonry wall structure as the masonry wall structure is being erected.

2. The combination defined in claim 1 wherein the terminal end portion of said anchor portion includes a pointed end portion for facilitating insertion through said at least one ICF foam panel into the supporting concrete back wall structure.

3. The combination defined in claim 1 wherein said tab member is positioned and located substantially perpendicular to said anchor portion.

4. The combination defined in claim 1 wherein said elongated slot is located adjacent said tab member.

5. A system for joining together a masonry wall structure with a supporting back wall structure wherein the supporting back wall structure is formed using an insulated concrete form (ICF) system having a plurality of individual ICF blocks aligned horizontally and vertically in an interlocking arrangement, each ICF block including a pair of spaced apart opposed ICF foam panels adapted for allowing poured concrete to flow therethrough, each opposed ICF panel having a plurality of flange members associated therewith, the system comprising:

a supporting back wall including a plurality of ICF blocks, each ICF block including a pair of opposed ICF foam panels, each ICF foam panel including a plurality of flange members;

concrete;

a masonry wall structure including courses of brick or other masonry material;

an anchor member attached to at least one of the ICF foam panels prior to pouring the concrete to form the back wall structure, said anchor member including an anchor portion having a terminal end portion sized and shaped so as to penetrate the ICF foam panel, wherein said anchor portion is inserted into and through said at least one ICF foam panel, and having at least one opening positioned and located so as to lie in the space between the pair of opposed ICF foam panels forming each ICF block when attached thereto for allowing poured concrete to flow therethrough;

the concrete encapsulating said anchor portion;

a majority of said anchor portion being comprised by said at least one opening;

an attachment portion including a tab member positioned and located so as to overlay one of the plurality of flange members when said anchor member is inserted within the ICF foam panel, said tab member having a plurality of openings cooperatively receiving fastening means for attaching the tab member to the ICF foam panel flange member;

said attachment portion further including an elongated slot;

and a tie member engaging said elongated slot, said tie member being adjustably movable along the length of said slot so as to be positioned in substantial alignment with a masonry mortar joint formed between the courses of brick or other masonry material as the masonry wall structure is being erected.

6. The system defined in claim 5 wherein the terminal end portion of said anchor portion includes a pointed end portion for facilitating the penetration of said anchor portion through the ICF foam panel.

7. The system defined in claim 5 wherein the terminal end portion of said anchor portion is substantially triangularly shaped so as to facilitate the penetration of said anchor portion through the ICF foam panel.

8. The system defined in claim 5 wherein said tab member is positioned substantially perpendicular to said anchor portion.

9. The system defined in claim 5 wherein said tie member includes an opening which receives a portion of said attachment portion thereby operatively engaging and positioning said tie member within said elongated slot.

10. The system defined in claim 5 wherein the masonry wall structure is spaced from the supporting back wall structure forming a space therebetween, said attachment portion extending into said space when said anchor member is attached to the ICF foam panel.

11. The system defined in claim 10 wherein said elongated slot lies in said space.

12. The system defined in claim 5 wherein said elongated slot is located adjacent said tab member.

* * * * *